US006763200B2

(12) United States Patent
Sakai et al.

(10) Patent No.: US 6,763,200 B2
(45) Date of Patent: Jul. 13, 2004

(54) IMAGE FORMING APPARATUS WITH TONER REPLACEMENT SENSOR

(75) Inventors: Masato Sakai, Tokyo (JP); Norio Ebata, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/087,058

(22) Filed: Feb. 28, 2002

(65) Prior Publication Data

US 2002/0122673 A1 Sep. 5, 2002

(30) Foreign Application Priority Data

Mar. 2, 2001 (JP) ..... 2001-058220

(51) Int. Cl.[7] ..... G03G 15/08

(52) U.S. Cl. ..... 399/27; 399/50; 399/53; 399/55

(58) Field of Search ..... 399/24, 26, 27, 399/28, 29, 38, 49, 50, 53, 55, 74, 176

(56) References Cited

U.S. PATENT DOCUMENTS 4,777,512 A * 10/1988 Takahashi et al. ..... 399/30
5,374,977 A * 12/1994 Shiina et al. ..... 399/27
5,778,279 A * 7/1998 Kawai et al. ..... 399/42
5,862,442 A * 1/1999 Ahn ..... 399/127
6,226,481 B1 * 5/2001 Yoneda et al. ..... 399/227
6,559,210 B2 * 5/2003 Murata ..... 399/176 R

* cited by examiner

*Primary Examiner*—Hoan Tran
(74) *Attorney, Agent, or Firm*—Akin Gump Strauss Hauer & Feld, LLP

(57) ABSTRACT

An image forming apparatus includes an image-forming unit having a charging section and a developing section that are rotated together with a photoconductor in an idling manner. The charging section and developing section receive voltages while rotating. The apparatus includes a toner sensor and a controller. The toner sensor outputs a detection signal indicating that the toner has been replenished in the image-forming unit. In accordance with the detection signal, the controller changes the voltages, a time length during which the photoconductor, charging section, and developing section are rotated, or speeds at which the photoconductor, charging section, and developing section are rotated. The time length is extended or speeds are increased when the image-forming unit has been replaced.

16 Claims, 6 Drawing Sheets

FIG.3

| OUTPUT OF TONER SENSOR | OUTPUT VOLTAGE OF SP BIAS POWER SUPPLY | | | | OUTPUT VOLTAGE OF DB BIAS POWER SUPPLY | | | |
|---|---|---|---|---|---|---|---|---|
| $Q \geqq M_1$ | $V_1$(42Y) | $V_1$(42M) | $V_1$(42C) | $V_1$(42B) | $V_1$(43Y) | $V_1$(43M) | $V_1$(43C) | $V_1$(43B) |
| $M_1 > Q > M_2$ | $V_2$(42Y) | $V_2$(42M) | $V_2$(42C) | $V_2$(42B) | $V_2$(43Y) | $V_2$(43M) | $V_2$(43C) | $V_2$(43B) |
| $Q \leqq M_2$ | $V_3$(42Y) | $V_3$(42M) | $V_3$(42C) | $V_3$(42B) | $V_3$(43Y) | $V_3$(43M) | $V_3$(43C) | $V_3$(43B) |

IMAGE FORMING APPARATUS WITH TONER REPLACEMENT SENSOR

FIELD OF THE INVENTION

The present invention relates to an image-forming apparatus that is mounted on, for example, an electrophotographic recording apparatus and a copying machine.

DESCRIPTION OF THE RELATED ART

When a conventional electrophotographic recording apparatus such as a color electrophotographic recording apparatus is powered on, a fixing roller is heated so that the surface of the fixing roller reaches a predetermined temperature. Then, a carrier belt for transporting print paper is driven to run more than one complete round, so that a photoconductor, a charging roller, a developing roller and associated structural members rotate in an idling manner, while also receiving the same voltages as applied during printing. Then, the rotating structural members are stopped, so that the system enters a standby condition in which the recording apparatus waits for a print command. The idling rotation of the rotating structural members allows the toner in the developing section to be pre-charged triboelectrically.

With the conventional image-forming apparatus, immediately after a toner cartridge or a photoconductive drum has been replaced at the end of its lifetime, the fresh toner supplied to the photoconductor is not charged sufficiently yet. Therefore, the aforementioned normal idling rotation do not allow the toner to be charged sufficiently, resulting in poor print quality.

SUMMARY OF THE INVENTION

An object of the present invention is to provide an image-forming apparatus in which even when a toner cartridge or an image-forming unit is replaced, a good print quality is maintained.

An image forming apparatus has an image-forming unit in which a charging section and a developing section are rotated together with a photoconductor in an idling manner while also receiving voltages. The apparatus includes a sensor and a controller. The sensor outputs a detection signal indicating that the toner has been replenished in the image-forming unit. The controller controls the conditions of operation of the charging section, the developing section, and the photoconductor. The set of voltages, the set of speeds, and the time length are changed in accordance with the detection signal.

The detection signal may indicate an amount of toner in the image-forming unit, and the controller controls the voltages to change in accordance with the detection signal.

When the image-forming unit is nearly full of toner, the detection signal is equal to or higher than a first value and the controller sets the voltages to first voltage values. When the detection signal is lower than the first value, the controller sets the voltages to second voltage values lower than the first voltage values.

When the charging section, the developing section, and the photoconductor are rotating in the idling manner, the controller sets the voltages to first voltage values higher than third voltage values which are voltage values applied during printing.

When the image-forming unit is nearly empty of toner, the detection signal is equal to or less than a second value smaller than the first value. When the charging section, the developing section, and the photoconductor are rotating in the idling manner, the controller sets the voltages to fourth voltage values lower than the second voltage values.

The fourth voltage values are lower than the third voltage values.

The charging unit receives a voltage such that a surface of the photoconductor is charged by the charging unit to a substantially same potential as is charged by the developing unit.

The sensor outputs a detection signal indicative of an amount of toner in the image-forming unit. The controller controls a time length during which the photoconductor, charging section, and developing section are rotated, the time length being changed in accordance with the detection signal.

When the image-forming unit is nearly full of toner, the detection signal is equal to or higher than a first value and the controller sets the time length to a first time length. When the detection signal is lower than the first value, the controller sets the time length to a second time longer than the first time length.

The sensor outputs a detection signal indicative of an amount of toner in the image-forming unit. The controller controls rotational speeds at which the photoconductor, charging section, and developing section are rotated, the speeds being changed in accordance with the detection signal.

When the image-forming unit is nearly full of toner, the detection signal is equal to or higher than a first value and the controller sets the speeds to first speeds. When the detection signal is lower than the first value, the controller sets the rotational speeds to second speeds higher than the first speeds.

The detection signal indicates that the image-forming unit has been replaced, and the controller controls a time length during which the photoconductor, charging section, and developing section are rotated, the time length being changed in accordance with the detection signal.

The controller may include a wear value storing area, a lifetime value storing area, and a lifetime determining section. The wear value storing area that stores a wear value indicative of a degree of wear-out of the photoconductor. The lifetime value storing area that stores a lifetime value of the photoconductor. The lifetime determining section that compares the wear value with the lifetime value to determine whether the photoconductor has reached an end of its lifetime.

The detection signal may indicate that the image-forming unit has been replaced. The controller may control rotational speeds at which the photoconductor, charging section, and developing section are rotated, the rotational speeds being changed in accordance with the detection signal.

The controller may include a wear value storing section, a lifetime value storing area, and a lifetime determining section. The wear value storing section that stores a wear value indicative of a degree of wear-out of the photoconductor. The lifetime value storing area that stores a lifetime of the photoconductor. The lifetime determining section that compares the wear value with the lifetime value to determine whether the photoconductor has reached an end of its lifetime.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 3 is a table that lists the output voltages of DP bias power supplies and DB bias power supplies for various amount of toner remaining in the developing unit;

DETAILED DESCRIPTION OF PREFERRED EMBODIMENTS

First Embodiment

Construction

Figure 1:
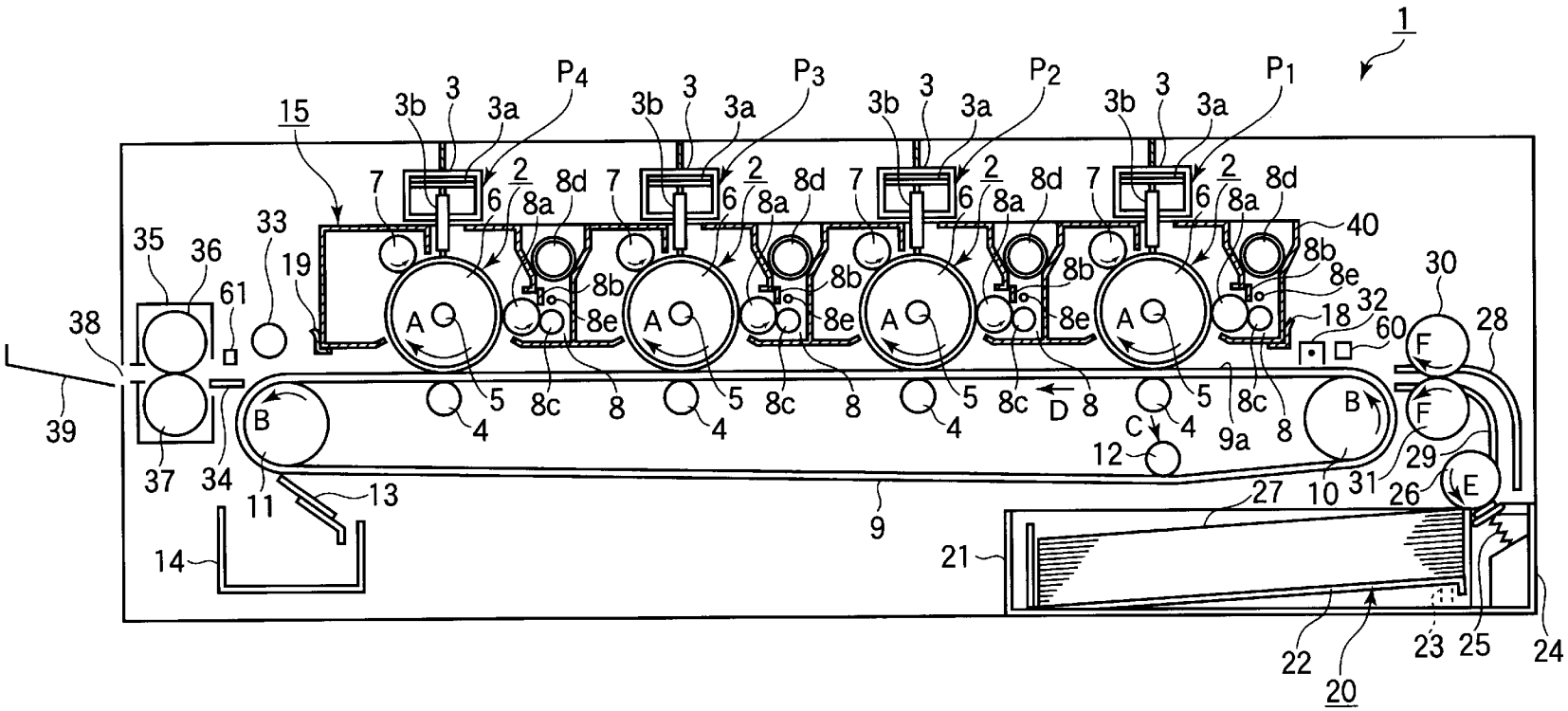
FIG. 1 illustrates a general configuration of a color electrophotographic recording apparatus.

FIG. 1 illustrates a general configuration of a color electrophotographic recording apparatus. Referring to FIG. 1, a color electrophotographic recording apparatus includes four printing mechanisms P1, P2, P3, and P4 aligned in this order from a medium-feeding end to a medium-discharging end of the apparatus. The four printing mechanisms P1, P2, P3, and P4 are electrophotographic LED-type printing mechanisms of the same configuration.

The first printing mechanism P1 includes an image-forming section 2, an LED head 3 that illuminates a later described photoconductor 6 in accordance with image date, and a transfer roller that transfers a toner image formed by the image-forming section 2 onto a print medium. The image-forming section 2 includes the photoconductor 6 that rotates about a shaft 5 in a direction shown by arrow A, a charging roller 7 that charges the surface of the photoconductor 6, and a developing unit 8.

The developing unit 8 includes a developing roller 8*a*, a developing blade 8*b*, a toner-supplying roller 8*c*, a toner tank 8*d*, and a toner sensor 8*e* that detects an amount of remaining toner. Non-magnetic one-component toner supplied from the toner tank 8*d* is supplied through the toner-supplying roller 8*c* to the developing blade 8*b*. The blade 8*b* in turn forms a thin toner layer on the developing roller 8*a*. The thin layer of toner formed on the developing roller 8*a* is brought into contact with the photoconductor 6.

The toner sensor 8*e* is integral with a toner agitator provided near the toner-supplying roller 8*c* of each printing mechanism. As shown in, for example, Japanese Patent Publication (KOKAI) No. 5-11610, an amount of toner remaining in the developing unit 8 is detected in terms of the rotational speed of the toner agitator that depends on the mechanical resistance exerted by the toner on the agitator when the agitator rotates.

The toner is subjected to triboelectric charging when it is strongly rubbed between the developing roller 8*a* and the developing blade 8*b*. In the present embodiment, the toner is negatively charged. The toner-supplying roller 8*c* delivers an appropriate amount of toner to the developing blade 8*b*. The developing roller 8*a* is formed of a semiconductive rubber material. When the toner is exhausted, the user replaces the toner cartridge 8*d* by a new, unused one for supplying fresh toner.

The LED head 3 includes LED arrays, a printed circuit board 3*a* that carries the LED arrays and drive ICs thereon for driving the LED arrays, and a SELFOC lens array 3*b* that focuses the light emitted from the LED arrays. The LED arrays of the LED head 3 are energized in accordance with image data received through a later described interface section 50 to illuminate the surface of the photoconductor 6, thereby forming an electrostatic latent image on the surface of the photoconductor 6.

The toner on the circumferential surface of the developing roller 8*a* migrates by the Coulomb force to the electrostatic latent image formed on the photoconductor 6 to develop the electrostatic latent image into a toner image. A carrier belt 9 is mounted in such a manner that it is sandwiched between the photoconductor 6 and the transfer roller 4 and runs between the two.

The developing units 8 of the first, second, third, and fourth printing mechanisms P1, P2, P3, and P4 hold yellow (Y) toner, magenta (M) toner, cyan (C) toner, and black (B) toner, respectively.

The LED heads 3 of the first, second, third, and fourth printing mechanisms P1, P2, P3, and P4 receive yellow image signal, magenta image signal, cyan image signal, and black image signal, respectively.

A case 40 houses the first to fourth printing mechanisms P1, P2, P3, and P4 therein to form a color image-forming unit 15. The color image-forming unit 15 is placed in position by means of positioning members 18 and 19 in such a way that the color image-forming unit 15 is releasable from the color electrophotographic recording apparatus 1.

The carrier belt 9 is an endless belt formed of a high resistance semiconductive plastic film, and is mounted on a drive roller 10, a driven roller 11, and a tension roller 12. The carrier belt 9 has an electrical resistance such that a later described recording medium 27 is electrostatically attracted to the carrier belt 9 and the static electricity remaining on the carrier belt can be dissipated when the recording medium 27 has left the carrier belt 9.

The driven roller 10 is connected to a motor, which will be described later. The motor drives the driven roller 10 in a direction shown by arrow B. The tension roller 12 is urged by a spring, not shown, in a direction shown by arrow C so that the carrier belt is always held taut. The carrier belt 9 runs with its upper half sandwiched between the photoconductors 6 of the respective printing mechanisms and the corresponding transfer rollers 4.

A cleaning blade 13 presses the carrier belt 9 with the carrier belt 9 sandwiched between the driven roller 11 and the cleaning blade 13. The cleaning blade 13 is formed of a flexible rubber material or a plastic material. The cleaning blade 13 has a tip in pressure contact with the carrier belt 9 to scrape the toner off the carrier belt 9 into the waste toner tank 14. In the present embodiment, the carrier belt 9 runs in contact with both the photoconductor 6 and transfer roller 4.

A medium-feeding mechanism 20 is disposed at a lower right corner of the color electrophotographic recording apparatus 1. The medium-feeding mechanism 20 includes a medium cassette, a hopping mechanism, and registry rollers 30 and 31. The medium cassette includes a recording medium holder 21, a plate 22, and an urging member 23. The hopping mechanism includes a medium separator 24, a spring 25, and a feeding roller 26. The hopping mechanism feeds the recording medium 27 to a pair of registry rollers 30 and 31, the recording medium being guided by the guides 28 and 29.

A charging unit 32 is disposed over the carrier belt 9 between the registry rollers 30 and 31 and the first printing mechanism P1. The charging unit 32 charges the recording medium 27 fed by the medium-feeding mechanism 20 so that the recording medium 27 is electrostatically attracted to the upper surface of the carrier belt 9. A photo interrupter 60 is disposed upstream of the charging unit 32 with respect to a direction of travel of the recording medium 27, detecting the leading edge of the recording medium 27.

A neutralizer 33 is disposed over the carrier belt 9 near the driven roller 11. When the recording medium 27 electrostatically attracted to the carrier belt 9 passes under the neutralizer 33, the neutralizer 33 neutralizes the recording medium 27, facilitating easy separation of the recording medium 27 from the carrier belt 9. A photo interrupter 61 is disposed to the left of the neutralizer 33 and detects the trailing end of the recording medium 27.

A guide 34 and a fixing unit 35 are provided to the left of the neutralizer 33. The fixing unit 35 fixes a toner image transferred on the recording medium 27. The fixing unit 35 includes a heat roller 36 that heats the toner on the recording medium 27, a pressure roller 37 that cooperates with the heat roller 36 to hold the recording medium 27 in pressure contact with the heat roller 36. The recording medium 27 passes between the heat roller 36 and pressure roller 37 to a stacker 39 through a discharge slit 38. The stacker 39 holds a stack of printed recording media discharged from the electrophotographic recording apparatus.

Figure 2:
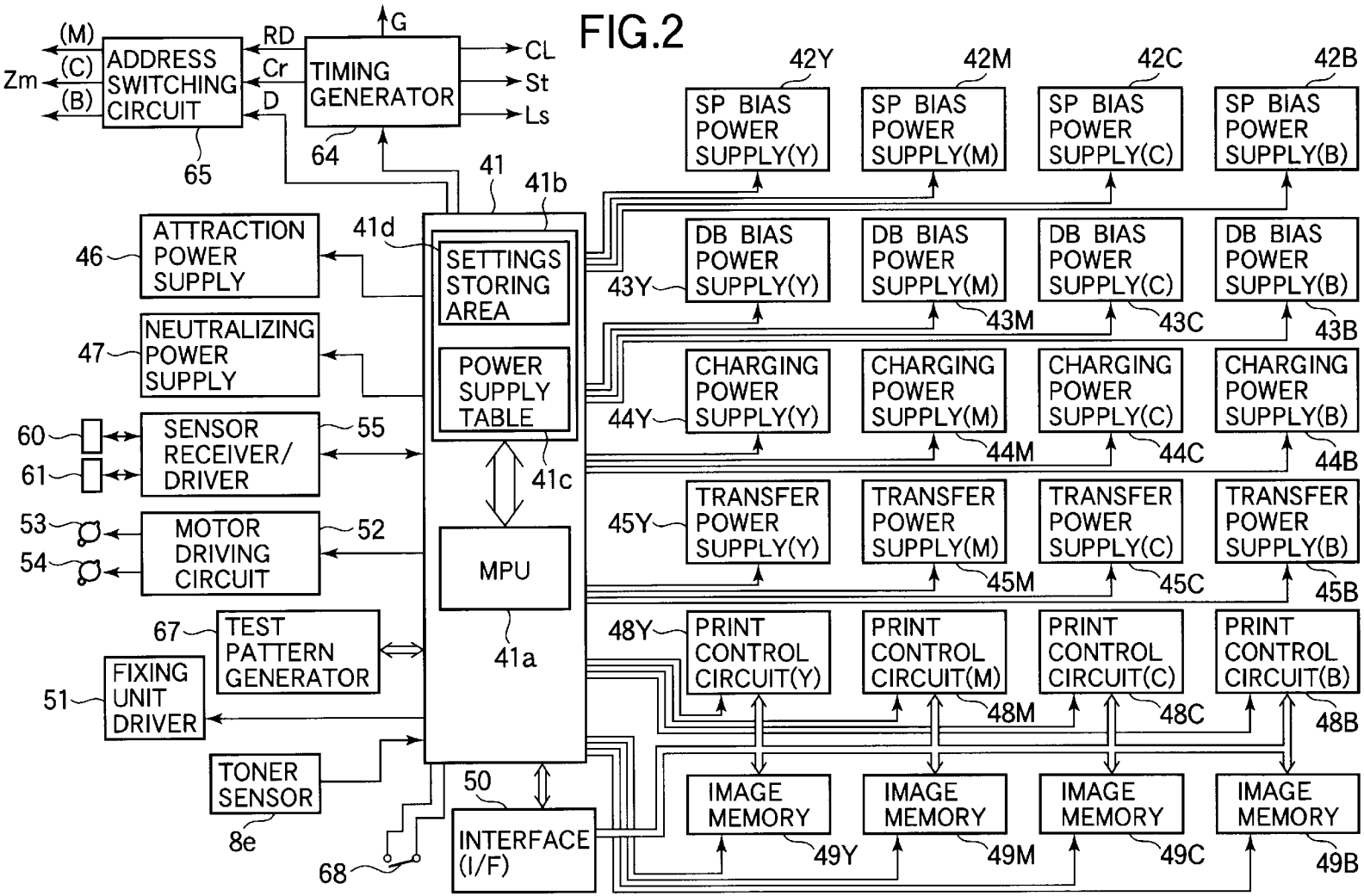
FIG. 2 is a control block diagram, illustrating the first embodiment.

FIG. 2 is a control block diagram, illustrating the first embodiment.

FIG. 3 is a table that lists the output voltages of DP bias power supplies and DB bias power supplies for various amounts of toner remaining in the developing unit.

Referring to FIG. 2, references Y (yellow), M (magenta), C (cyan), and B (black) corresponds to the first to fourth printing mechanisms P1, P2, P3, and P4. A controller 41 includes a microprocessor 41*a* (referred to as MPU 41*a* hereinafter) and a memory 41*b*. The controller 41 refers primarily to a power supply table 41*c* and a settings-storing area 41*d* to control the overall operation of the color electrophotographic recording apparatus 1. Specifically, the memory takes the form of a ROM.

The controller 41 is connected to SP bias power supplies 42Y, 42M, 42C, and 42B that supply electric power to the developing units 8 of the respective printing mechanisms P1–P4. As shown in FIG. 3, the SP bias power supplies 42Y, 42M, 42C, and 42B can be switched to change voltages supplied to the corresponding toner-supplying rollers in accordance with the outputs of the toner sensor 8*e* when the printing mechanisms are rotating in an idle manner, and voltages V2(42Y), V2(42M), V2(42C), and V2(42B) to the toner-supplying rollers 8*c* of the corresponding developing units 8 when the printing mechanisms are actually performing printing.

When the output Q of the toner sensor 8*e* is equal to or higher than a first value M1 which indicates that the toner tank 8*d* is nearly full of toner, voltages V1(42Y), V1(42M), V1(42C), and V1(42B) are applied to the toner-supplying rollers 8*c* of the respective developing units 8. When the output Q of the toner sensor 8*e* is less than a second value M2 which indicates that the toner tank 8*d* is nearly empty of toner, voltages V3(42Y), V3(42M), V3(42C), and V3(42B) are applied to the toner-supplying rollers 8*c* of the respective developing units 8.

The voltages of the SP bias power supplies for Y, M, C, and B are in the relation of V3<V2<V1.

After toner has been replenished into the toner tank 8*d* by replacing the toner cartridge, an amount of toner in the toner tank 8*d* is equal to or more than the first value M1. The output Q of the toner sensor 8*e* may be stored in the controller 41 until the next value is received from the toner sensor 8*e*. If a currently detected output Q of the toner sensor 8*e* is greater than the first value M1 and a previously stored value is less than M1, then it can be determined that the toner cartridge 8*d* has been replaced. The second value M2 indicates an amount of toner in the toner tank 8*d* when the toner in the toner tank 8*d* is nearly exhausted. The first value M1 and second value M2 are determined experimentally.

The controller 41 is connected to DB bias power supplies 43Y, 43M, 43C, and 43B that supply electric power to the developing rollers 8*a* of the developing units 8 of the printing mechanisms P1–P4. As shown in FIG. 3, the output voltages of the DB bias power supplies 43Y, 43M, 43C, and 43B can be changed during idling rotation, so that the developing rollers 8*a* receive different voltages in accordance with the output Q of the toner sensor 8*e*. The output voltages of the DB bias power supplies 43Y, 43M, 43C, and 43B are switched to V2(43Y), V2(43M), V2(43C), and V2(43B) during a printing operation.

In other words, when the output Q of the toner sensor 8*e* is higher than the first value M1, then the voltages V1(43Y) V1(43M), V1(43C), and V1(43B) are applied to the developing rollers 8*a* of the respective developing units 8. When the output Q of the toner sensor 8*e* is less than the second value M2, then the voltages V3(43Y), V3(43M), V3(43C), and V3(43B) are applied to the developing rollers 8*a* of the respective developing units 8.

The output voltages of the DB bias power supplies for Y, M, C, and B are in the relation of V3<V2<V1.

The output voltages of the DB bias power supplies for Y, M, C, and B and those of the SP bias power supplies for Y, M, C, and B are in the relation of V3(42Y)≧V3(43Y), V3(42M)≧V3(43M), V3(42C)≧V3(43C), and V3(42B) ≧V3(43B) respectively.

The controller 41 is connected to the toner sensor 8*e*. The controller 41 reads the first and second values M1 and M2 from the settings-storing area 41*d*, and refers to the power supply table 41*c* to switch the output voltages of the SP bias power supplies and DB bias power supplies during the idling rotation of printing mechanisms.

The controller 41 is also connected to the charging power supplies 44Y, 44M, 44C, and 44B that supply electric power to the charging rollers 7 of the respective printing mechanisms P1–P4, and transfer power supplies 45Y, 45M, 45C, and 45B that supply electric power to the respective transfer rollers 4. The controller 41 refers to the power supply table 41*c* to control the charging power supplies 44Y, 44M, 44C, and 44B and the transfer power supplies 45Y, 45M, 45C, and 45B.

The controller 41 is also connected to an attraction power supply 46 that supplies electric power to the charging unit 32 and a neutralizing power supply 47 that supplies high voltage electric power to the neutralizer 33. The controller 41 controls the aforementioned power supplies to turn on and off.

The controller 41 is connected to print controlling circuits 48Y, 48M 48C, and 48B that control the printing mechanisms P1–P4, respectively. The print controlling circuits 48Y, 48M 48C, and 48B receive image data from image memories 49Y, 49M, 49C, and 49B, and provides the received image data to the LED heads 3 under the command from the controller 41 to control the time length during which the LEDs are energized to form an electrostatic latent image on the surface of the photoconductor 6. The image memories 49Y, 49M, 49C, and 49B take the form of a RAM.

An interface 50 separates image data, received from an external apparatus such as a host computer, into images of respective colors. Then, the interface 50 stores yellow image data, magenta image data, cyan image data, and black image data into the image memory 49Y, image memory 49M, image memory 49C, and image memory 49B, respectively.

The fixing unit driver 51 controls a heater, not shown, within the heat roller 36 so as to maintain the surface temperature of the heat roller 36 in the fixing unit 35. A motor driving circuit 52 drives a motor 53 and a motor 54. The motor 53 drives the feeding roller 26. The motor 54 drives the registry rollers 30 and 31, photoconductors 6 of the printing mechanisms P1–P4, charging rollers 7, developing rollers 8*a*, toner-supplying rollers 8*c*, transfer rollers 4, drive roller 10, and heat roller 36. The rollers driven by the motor 54 are connected through gears or belts, not shown. A sensor receiver/driver 55 drives the photo interrupters 60 and 61 and provides the output waveforms of the photo interrupters 60 and 61 to the controller 41.

A timing generator 64 takes the form of, for example, a programmable counter and generates pulse signals such as clock CL, start signal St, line signal Ls, read signal RD, and switch latch clear signal Cr, which are sent to the respective circuits of FIG. 2 as required.

The address select signal generator 65 receives the read signal RD and the switch-latch clear signal Cr from the timing generator 64 and generates a periodic address-select signal Zm at timings according to data D specified by the controller 41.

Overall Operation

When a switch 68 is operated to turn on the color electrophotographic recording apparatus 1, the controller 41 performs predetermined initial set-up operations and then drives the fixing unit driver 51 to perform a warm-up operation in which the heat roller 36 is energized to a predetermined temperature. The controller 41 controls the heat roller 36 to maintain the heat roller 36 to a constant temperature.

When the heat roller 36 reaches a predetermined temperature, the controller 41 controls the motor driving circuit 52, thereby causing the motor 54 to drive in rotation the registry rollers 30 and 31, photoconductors of the printing mechanisms P1–P4, charging rollers 7, developing rollers 8*a*, toner-supplying rollers 8*c*, transfer rollers 4, drive rollers 10, and heat roller 36. The drive roller 10 drives the carrier belt 9 to run in a direction shown by arrow D for cleaning the surface of the carrier belt 10.

At this moment, the controller 41 applies the same voltages as are applied during printing to the photoconductors 6, charging rollers 7, developing rollers 8*a*, toner-supplying rollers 8*c*, and transfer rollers 4. The controller 41 also detects an amount of toner remaining in the developing unit 8 by means of the toner sensor 8*e*. When the output Q of the toner sensor 8*e* is higher than the first value M1, the MPU 41*a* refers to the power supply table 41*c* to change the output voltages of the SP bias power supplies and DB bias power supplies. In other words, the controller 41 applies the voltages V1(42Y), V1(42M), V1(42C), and V1(42B) to the toner-supplying rollers 8*c*, and the voltages V1(43Y), V1(43M), V1(43C), and V1(43B) to the developing rollers 8*a*, thereby causing the toner to be charged sufficiently during printing.

When the output Q of the toner sensor 8*e* is lower than the second value M2, the MPU 41*a* also refers to the power supply table 41*c* to change the output voltages of the SP bias power supplies and DB bias power supplies. In other words, the controller 41 applies the voltages V3(42Y), V3(42M), V3(42C), and V3(42B) to the toner-supplying rollers 8*c*, and the voltages V3(43Y), V3(43M), V3(43C), and V3(43B) to the developing rollers 8*a*, so that the toner supplied from the toner-supplying roller 8*c* to the developing roller 8*a* is not charged more than necessary during printing.

When the carrier belt 9 has run a little longer than one complete rotation, the controller 41 stops the motor 54 so that the carrier belt 9 stops. Thus, the residual toner and dust deposited on the carrier belt 9 are scraped off the carrier belt 9 by a cleaning blade 13 into a waste toner tank 14.

The toner in the respective developing unit 8*a* is held charged to a reasonable potential.

Then, the color electrophotographic recording apparatus 1 enters a standby state where the apparatus 1 waits for image data that is sent from an external host apparatus through the interface 50.

Upon receiving image data from the external host apparatus such as a host computer through the interface 50, the controller 41 outputs commands to the interface 50 and the respective image memories 49Y, 49M, 49C, and 49B. In response to the command, the interface 50 separates the received image data into yellow image data, magenta image data, cyan image data, and black image data and stores into the corresponding image memories 49Y, 49M, 49C, and 49B. In this manner, the image memories 49Y, 49M, 49C, and 49B hold corresponding image data for one page of the recording medium 27.

Printing Operation

The operation of printing image data will be described. The controller 41 controls the motor driving circuit 52 to drive the motor 53, thereby causing the feed roller 26 to rotate. The rotation of the feed roller 26 causes a top page of a stack of recording medium 27 to advance from the recording medium holder 21 to the guides 28 and 29. The controller 41 controls the motor driving circuit 52 in such a way that the motor 53 continues to rotate a little longer after the leading edge of the recording medium 27 arrives at the registry rollers 30 and 31. Thus, the recording medium 27 will have a slack after the recording medium 27 abuts the registry rollers 30 and 31, thereby eliminating a skewed condition of the recording medium 27.

Then, the controller 41 controls the motor driving circuit 52 to cause the motor 54 to rotate, thereby driving in rotation the photoconductors 6, charging rollers 7, developing rollers 8*a*, toner-supplying rollers 8*c*, and transfer rollers 4 of the printing mechanisms P1–P4, heat roller 36 of the fixing unit 35, registry rollers 30 and 31, and drive rollers 10. At the same time, the controller 41 turns on the charging power supplies 44Y, 44M, 44C, and 44B, the DB bias power supplies 43Y, 43M, 43C, and 43B and the SP bias power supplies 42Y, 42M, 42C, and 42B in order to supply voltages to the charging rollers 7, developing rollers 8*a*, and toner-supplying rollers 8*c* of the respective printing mechanisms P1–P4.

The SP bias power supplies 42Y, 42M, 42C, and 42B apply the voltages V2(42Y), V2(42M), V2(42C), and V2(42B) to the toner-supplying rollers 8*c* of the respective developing units 8. The DB bias power supplies 43Y, 43M, 43C, and 43B apply the voltages V2(43Y), V2(43M), V2(43C), and V2(43B) to the developing rollers 8*a* of the respective developing units 8.

In this manner, the surfaces of the photoconductors 6 of the respective printing mechanisms P1–P4 are charged uniformly by the charging rollers 7, and the toner-supplying rollers 8*c* and developing rollers 8*a* are charged to a predetermined potential.

The controller 41 then outputs a command to the image memory 49Y that holds the yellow image data, so that the image memory 49Y transmits the yellow image data for one line to the print controlling circuit 48Y of the first printing mechanism P1. In response to the command, the print controlling circuit 48Y converts the image data received from the image memory 49Y into a data structure that can be transmitted to the LED head 3 of the first printing mechanism P1 and transmits the converted data to the LED head 3. The LED head 3 energizes the LEDs in accordance with the received image data to form an electrostatic latent image of one line on the surface of the photoconductor 6 in accordance with the image data. In this manner, yellow image data for each line received from the image memory 49Y is converted into an electrostatic latent image on the photoconductor 6 on a line-by-line basis. This process is repeated in an advance direction to form an entire image data on the surface of the photoconductor 6.

Charged yellow toner is deposited on the electrostatic latent image formed on the surface of the photoconductor 6. Thus, as the photoconductor 6 rotates, the electrostatic latent image is developed with the charged yellow toner into a yellow toner image.

When the leading edge of the recording medium 27 reaches a transfer point defined between the photoconductor 6 and the transfer roller 4, the controller 41 turns on the transfer power supply 45Y, so that the toner image on the photoconductor 6 is transferred electrostatically onto the recording medium 27. As the photoconductor 6 continues to rotate, the toner image is transferred successively until one page of yellow image is formed on the recording medium 27. When the trailing edge of the recording medium 27 reaches the transfer point, the controller 41 turns off the transfer power supplies 45Y, charging power supply 44Y, SP bias power supply 42Y, and DB bias power supply 43Y of the first printing mechanism P1.

The carrier belt 9 still continues to run so that the recording medium 27 passes through the second printing mechanism P2, third printing mechanism P3, and fourth printing mechanism P4, so that the magenta toner image, cyan toner image, and black toner image are transferred.

As describe above, the respective toner images are transferred in registration on the recording medium 27. Then, the recording medium 27 advances to the neutralizer 33 and the controller 41 turns on the neutralizing power supply 47 to neutralize the recording medium 27.

By the time the recording medium arrives at the fixing unit 35, the heat roller 36 of the fixing unit 35 has reached a temperature sufficient for fixing the toner image. Thus, when recording medium 27 passes between the heat roller 36 and pressure roller 37, the toner image on the recording medium 27 is fused into a permanent color image. After fixing, the recording medium 7 is discharged to the stacker 39. When the photo interrupter 61 detects the trailing edge of the recording medium 27, the controller 41 knows that the recording medium 27 has been discharged.

Upon discharge of the recording medium 27, the controller 41 controls the motor driving circuit 52, thereby stopping the motor 54. This completes the printing operation.

In the present invention, the voltages are applied to the toner-supplying rollers and developing rollers in accordance with the amount of toner remaining in the developing unit. Alternatively, the system may be modified to change time during which the printing mechanisms rotate, or rotational speed at which the printing mechanisms rotate. Still alternatively, the respective rollers may be changed in rotational direction, circumferential speed, or the amount of nip.

According to the first embodiment, when an amount of toner remaining in the developing unit is higher than a predetermined value, the toner-supplying rollers and developing rollers in an idling manner receive voltages higher than those when a printing operation is performed. This prevents insufficient charging of the toner shortly after the toner cartridge 8*d* is replaced to replenish toner in the developing unit, so that toner transferred to the recording medium is maintained constant during printing.

If the amount of toner remaining in the developing unit is lower than a predetermined value, then the toner-supplying roller and developing roller receive voltages lower than those when a printing operation is performed. Applying voltages in this manner prevents the overcharging of the toner on the developing rollers, thereby maintaining the density of toner deposited on the recording medium 27 during printing.

Second Embodiment

In the first embodiment, the developing rollers 8*a* and toner-supplying rollers 8*c* receive voltages higher or lower voltages during idling rotation than during printing, depending on the amount of toner remaining in the developing unit. A second embodiment is featured in that the charging rollers 7 receives controlled voltages during idling rotation.

During printing, the charging roller causes the surface of the photoconductor 6 to be charged to about −800 V, which is about three times the voltage applied to the developing rollers 8*a*. Thus, during idling rotation, the toner deposited on the developing rollers 8*a* is charged to a high negative voltage every time it passes the area in contact with the photoconductor 6. This increases the negative potential of toner on the developing roller 8*a* more than necessary.

In the second embodiment, the charging roller 7 receives a relatively low voltage during idling rotation, so that the surface of the photoconductor 6 is charged by the charging unit to substantially the same potential as it is charged by the developing_unit. This prevents the toner deposited on the developing rollers from being overcharged, maintaining the density of toner transferred to the recording medium 27.

Third Embodiment

In the first and second embodiments, the voltages applied to the developing rollers, toner-supplying rollers, and charging rollers are changed during idling rotation. The printing mechanisms may be controlled to operate in such a way that the voltages applied during idling rotation are the same as those applied during printing, and the idling rotation is performed for a longer time so that charges on the toner are sufficiently accumulated triboelectrically.

The third embodiment is featured in that when the image-forming unit 15 is replaced by a new, unused one, idling rotation is performed longer than the normal idling rotation so as to accumulate sufficient charge triboelectrically.

The configuration of a third embodiment is the same as that of the first and second embodiment and the description thereof is omitted. Thus, the third embodiment will be described with reference to FIG. 4.

Figure 4:
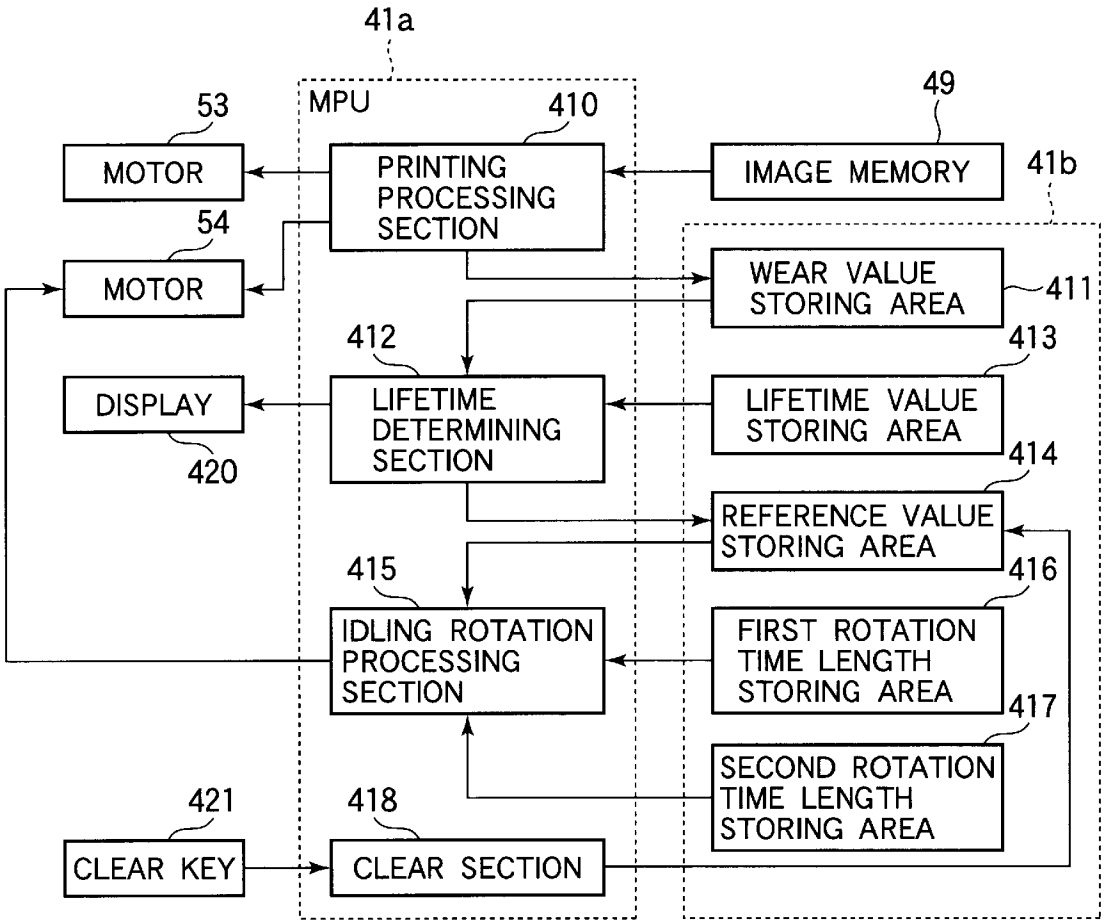
FIG. 4 is a control block diagram according to the third embodiment.

FIG. 4 is a control block diagram according to the third embodiment.

A printing processing section 410 drives the motor 53 to advance a top page of a stack of recording medium 27 from the recording medium holder 21 of FIG. 1. The printing processing section 410 also drives the motor 54 and LED head 3 to form an electrostatic latent image in accordance with the image data read from the image memory 49 on the surface of the photoconductor 6, convert the electrostatic latent image into a toner image, then subsequently transfer to the recording medium 27, and finally discharge the recording medium through the fixing unit 35 to the stacker 39. The printing processing section 410 increments the content of a wear value storing area 411 that stores a wear value indicative of the degree of wear-out of the apparatus 1.

A lifetime determining section 412 compares a lifetime value (e.g. a total number of rotation within the lifetime of the photoconductor 6) stored in a lifetime value storing area 413 with the content of the wear value storing area 411. If the content of the wear value storing area 411 exceeds the lifetime value, then the lifetime determining section 412 sets the content of the reference value storing section 414 to "1," and displays a message "REPLACE IMAGE-FORMING APPARATUS" on a display 420.

If the reference value (the content of the reference value storing section 414) is "0," then an idling rotation processing section 415 drives the motor 54 to perform idling rotation in accordance with a first rotation time length stored in a first rotation time length storing section 416. If the reference value (the content of the reference value storing section 414) is "1," then the idling rotation processing section 415 drives the motor 54 to perform idling rotation in accordance with a second rotation time length stored in a second rotation time length storing section 417.

When an operator depresses a clear key 421, a clear section 418 sets the content of the reference value storing section 414 to "0".

Specifically, the MPU 41*a* includes the printing processing section 410, lifetime determining section 412, idling rotation processing section 415, and clear section 418. The memory 41*b* includes the wear value storing area 411, lifetime value storing area 413, reference value storing section 414, first rotation time length storing section 416, and second rotation time length storing section 417.

Figure 5:
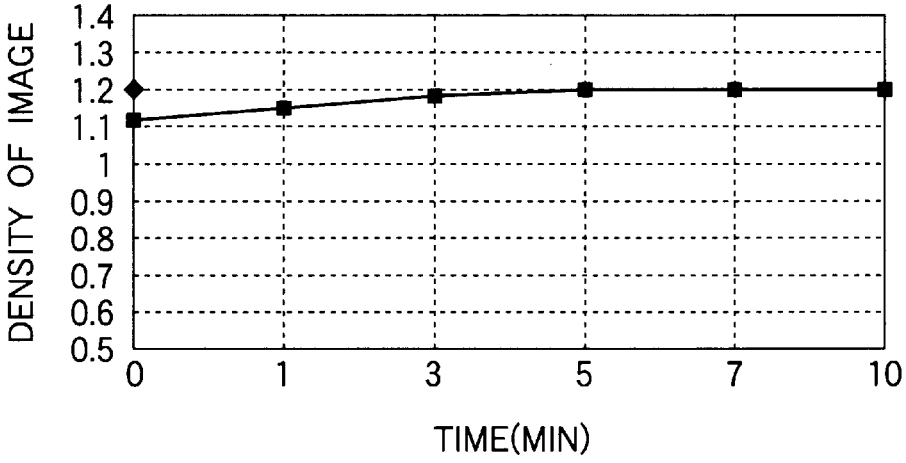
FIG. 5 illustrates the relationship between the idling time length and image density when the image-forming unit is replaced.

FIG. 5 illustrates the relationship between the idling time length and image density when the image-forming unit is replaced. FIG. 5 plots idling time length as the abscissa and image density as the ordinate. The image density reaches a stable value of 1.2 after the idle rotation has been performed for ten minutes.

When an image is exposed to light, the image reflects the light. Image density is a value D, which is a logarithmically expressed reciprocal of a reflection coefficient R from an image. When the reflection coefficient R is 1 (reflection coefficient is 100%), the image density D is zero (0). For example, if the reflection coefficient R=0.1, the image density D=1. Likewise, the reflection coefficient R=0.05, then the image density D=1.3.

Figure 6:
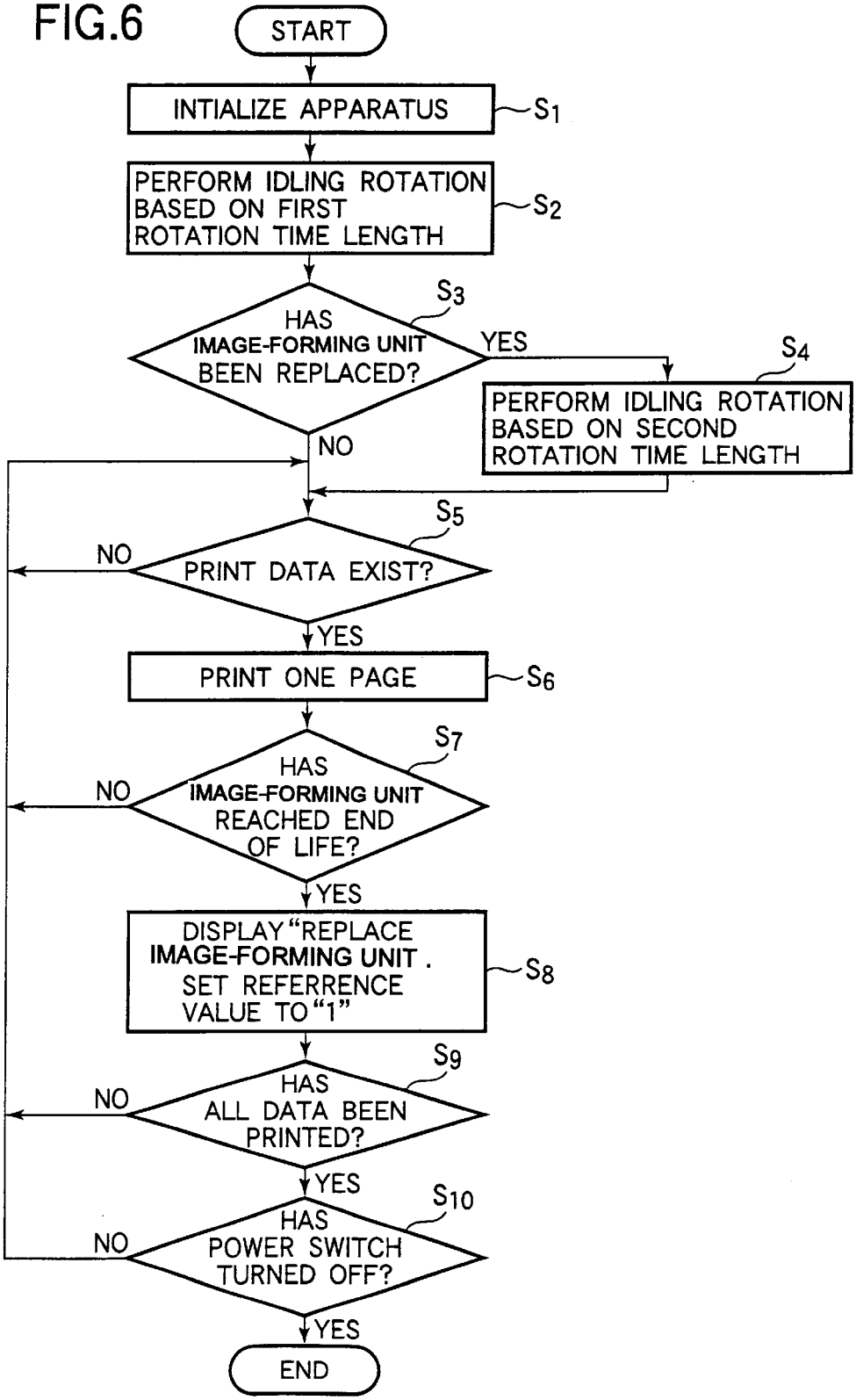
FIG. 6 is a flowchart illustrating the operation of the idling rotation.

FIG. 6 is a flowchart illustrating the operation of the idling rotation.

Upon power-up, the MPU 41*a* is reset and performs initialization at step S1. At this moment, the reference value of the reference value storing section 414 is set to "0."

At step S2, the MPU 41*a* reads the first rotation time length from the first rotation time length storing section 416 and performs a normal idling rotation.

At step S3, the MPU 41*a* refers to the reference value in the reference value storing section 414. If the reference value is "1," then it is determined that the image-forming unit has been replaced. Thus, the program proceeds to step S4. If NOT, then the program proceeds to step S5.

At step S4, the MPU 41*a* reads the second rotation time length from the second rotation time length storing section 417 and performs idling rotation for more than ten minutes.

At step S5, the MPU 41*a* detects whether print data exists. If the print data exists, then the program proceeds to step S6.

At step S6, the MPU 41*a* feeds a top page of the stack of recording medium 27 from the recording medium holder 21 to start a printing operation. The MPU 41*a* also reads the image data from the image memory 49 and performs the printing operation of the image data while also incrementing the content (accumulated number of rotations of the photoconductor 6) of the wear value storing area 411.

At step S7, the MPU 41*a* compares the content of the wear value storing area 411 with the content of the reference value storing section 414 to determine whether the developing unit has reached the end of lifetime. If YES, then the program proceeds to step S8, and if NO, then the program jumps back to step S5.

At step S8, the MPU 41*a* sets the reference value of the reference value storing section 414 to "1" and displays a message "REPLACE IMAGE-FORMING UNIT" on the display 420.

At step S9, the MPU 41*a* determines whether print data still exists in the image memory 49. If NO, the program proceeds to step S5; if YES, then the program proceeds to step S10.

At step S10, the MPU 41*a* checks whether the power switch of the apparatus has been turned off. If YES, then the program terminates; if NO, the program jumps back to step S5.

When the operator notices the message "REPLACE IMAGE-FORMING UNIT," he turns off the apparatus for replacement of the image-forming unit. After the replacement of the image-forming unit, the operator again turns on the apparatus 1. Then, the operator depresses the clear key 421 to set the reference value in the reference value storing section 414 to "0". In this case, idle rotation is performed for more than ten minutes at step S4 and then the program proceeds to step S5 where the program waits for print data.

The third embodiment has been described with respect to a case where the image-forming unit is replaced. The present invention is also applicable to a case where the toner cartridge 8*d* is replaced to replenish toner. In other words, the output Q of the toner sensor 8*e* is compared with a threshold value. If the output Q is larger than the threshold value, then the second rotation time length is read out and the idle rotation is performed for more than ten minutes. If the output Q is less than the threshold value, then the first rotation time length is read out and the idling rotation is performed.

In the third embodiment, the idle rotation time length is extended but the rotational speed may be increased instead, in which case, the rotation time length may be shortened.

According to the third embodiment, shortly after the image-forming unit is replaced at the end of lifetime of photoconductor, the idling rotation is performed for a longer time than the normal idling rotation operation, thereby accumulating sufficient amount of charge triboelectrically. This prevents the image density from degrading while still maintaining the same image density as before replacement.

While the first to third embodiments have been described with respect to a color electrophotographic recording apparatus, the present invention can also be applied to a monochrome electrophotographic recording apparatus.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus having an image-forming section that includes a developing unit, the apparatus comprising:

a detector configured to detect a developer in the image forming section to generate a detection signal; and a controller configured to control a developer-charging operation of the developing unit performed prior to a printing operation, the developer-charging operation being controlled in accordance with the detection signal of said detector.

2. The image forming apparatus of claim 1 wherein the detection signal indicates an amount of developer remaining in the image-forming section.

3. The image forming apparatus of claim 2 wherein when the detection signal is equal to or higher than a first value, said controller sets the developing unit to a first voltage; and when the detection signal is lower than the first value, said controller sets the developing unit to a second voltage, the second voltage being less effective in charging the developer than the first voltage.

4. The image forming apparatus of claim 3 wherein the first voltage is more effective in charging the developer than a voltage applied to the developing unit during the printing operation.

5. The image forming apparatus of claim 3 wherein when the detection signal is lower than a second value that is lower than the first value, said controller sets the developing unit to a third voltage that is less effective in charging the developer than the second voltage.

6. The image forming apparatus of claim 5 wherein the third voltage is less effective in charging the developer than the voltage applied to the developing unit during the printing operation.

7. The image forming apparatus of claim 3 further comprising a charging unit that charges an image bearing body that bears an electrostatic latent thereon, wherein said controller supplies a voltage to the charging unit, the voltage supplied to the charging unit being substantially the same as a voltage supplied by the developing unit to the image bearing body.

8. The image forming apparatus of claim 2 wherein said controller controls a length of time during which the developing unit rotates, the length of time being controlled in accordance with the detection signal.

9. The image forming apparatus of claim 8 wherein when the detection signal is equal to or higher than a first value, said controller sets the length of time to a first time length; and when the detection signal is lower than the first value, said controller sets the length of time to a second time length shorter than the first time length.

10. The image forming apparatus of claim 2 wherein said controller controls a rotational speed at which the developing unit rotates, the rotational speed being controlled in accordance with the detection signal.

11. The image forming apparatus of claim 10 wherein when the detection signal is equal to or higher than a first value, said controller sets the developing unit to a first rotational speed; and when the detection signal is lower than the first value, said controller sets the developing unit to a second rotational speed lower than the first rotational speed.

12. An image forming apparatus having an image-forming section that includes a developing unit, the apparatus comprising:

a replacement detector configured to detect replacement of the image-forming section; and a controller configured to control a developer-charging operation of the developing unit performed prior to a printing operation, the developer-charging operation being controlled in response to detection of replacement of the image-forming section.

13. The image forming apparatus of claim 12 wherein said controller controls a length of time during which the developing unit rotates, the length of time being controlled in response to detection of replacement of the image-forming section.

14. The image forming apparatus of claim 13 wherein said controller comprises:

a wear value storing area that stores a wear value indicative of a degree of wear-out of an image bearing body;

a lifetime value storage area that stores a lifetime value of the image bearing body; and a lifetime determining section that compares the wear value with the lifetime value to determine whether the image bearing body has reached an end of its lifetime.

15. The image forming apparatus of claim 12 wherein said controller controls a rotational speed at which the developing unit rotates, the rotational speed being controlled in response to detection of replacement of the image-forming section.

16. The image forming apparatus of claim 15 wherein said controller comprises:

a wear value storing area that stores a wear value indicative of a degree of wear-out of an image bearing body;

a lifetime value storing area that stores a lifetime value of the image bearing body; and a life determining section that compares the wear value with the lifetime value to determine whether the image bearing body has reached an end of its lifetime.

* * * * *